US012084935B2

(12) United States Patent
Alsheikh et al.

(10) Patent No.: US 12,084,935 B2
(45) Date of Patent: Sep. 10, 2024

(54) MECHANICAL AUTONOMOUS PUNCH AND CUT SYSTEM

(71) Applicant: SAUDI ARABIAN OIL COMPANY, Dhahran (SA)

(72) Inventors: Mohammed Alsheikh, Dammam (SA); Atef Shoman, Abqaiq (SA); Ossama R. Sehsah, Dhahran (SA); Amjad Alshaarawi, Khobar (SA); Richard Mark Pye, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/063,014

(22) Filed: Dec. 7, 2022

(65) Prior Publication Data

US 2024/0191586 A1 Jun. 13, 2024

(51) Int. Cl.
*E21B 29/00* (2006.01)
*E21B 31/16* (2006.01)
(Continued)

(52) U.S. Cl.
CPC ..... *E21B 29/005* (2013.01); *E21B 31/16* (2013.01); *E21B 43/119* (2013.01); *E21B 44/00* (2013.01); *E21B 47/09* (2013.01)

(58) Field of Classification Search
CPC ..... E21B 29/005; E21B 29/002; E21B 29/08; E21B 31/16; E21B 31/20; E21B 44/00; E21B 47/09; E21B 43/119
See application file for complete search history.

(56) References Cited

U.S. PATENT DOCUMENTS 10,815,745 B2 * 10/2020 Dewey ..... E21B 29/005
2005/0240351 A1 * 10/2005 Gray ..... E21B 47/09 702/6

(Continued)

FOREIGN PATENT DOCUMENTS

CN 114607305 A 6/2022
RU 155575 U1 10/2015

(Continued)

*Primary Examiner* — Nicole Coy
*Assistant Examiner* — Nicholas D Wlodarski
(74) *Attorney, Agent, or Firm* — Osha Bergman Watanabe & Burton LLP

(57) ABSTRACT

A mechanical autonomous pipe cutting system for cutting a pipe in a wellbore includes a locking unit that prevents the system from moving within the pipe when engaged to an inner surface of the pipe, a punching unit that moves a plurality of punching elements radially relative to an axis of the system, and a cutting unit that is designed to sever the pipe. The locking unit, the punching unit, and the cutting unit are attached to a body of the mechanical autonomous pipe cutting system. The body includes a motor that rotates the cutting unit. The mechanical autonomous pipe cutting system further includes a sensor module that detects interactions between the pipe and walls of the wellbore and a control unit in electronic communication with the sensor module, the locking unit, and the punching unit. The control unit actuates the locking unit and operates the punching unit subsequent to identifying a location where interaction between the pipe and the walls of the wellbore limits a downhole movement of the pipe based on an output of the sensor module.

20 Claims, 7 Drawing Sheets

(51) Int. Cl.

| | |
|---|---|
| ***E21B 43/119*** | (2006.01) |
| ***E21B 44/00*** | (2006.01) |
| ***E21B 47/09*** | (2012.01) |

(56) References Cited

U.S. PATENT DOCUMENTS

| | | | | |
|---|---|---|---|---|
| 2014/0374100 | A1* | 12/2014 | Hallundbaek | E21B 29/08 166/386 |
| 2018/0216432 | A1* | 8/2018 | Nelson | E21B 29/002 |
| 2019/0257168 | A1* | 8/2019 | Sunde | E21B 29/002 |
| 2019/0353032 | A1* | 11/2019 | Batarseh | E21B 7/15 |
| 2020/0072009 | A1* | 3/2020 | Fairweather | E21B 29/005 |
| 2022/0034182 | A1* | 2/2022 | Cullum | E21B 23/01 |
| 2022/0065061 | A1 | 3/2022 | Sehsah et al. | |
| 2022/0333454 | A1* | 10/2022 | Fairweather | E21B 31/20 |

FOREIGN PATENT DOCUMENTS

| | | | | |
|---|---|---|---|---|
| WO | WO-2017046613 | A1 * | 3/2017 | E21B 23/01 |
| WO | 2020/256563 | A1 | 12/2020 | |

* cited by examiner

MECHANICAL AUTONOMOUS PUNCH AND CUT SYSTEM

BACKGROUND

Hydrocarbon fluids are often found in hydrocarbon reservoirs located in porous rock formations below the earth's surface. Hydrocarbon wells may be drilled to extract the hydrocarbon fluids from the hydrocarbon reservoirs and may be drilled by running a drill string, comprised of a drill bit and a bottom hole assembly, into a wellbore to break the rock and extend the depth of the wellbore. A fluid may be pumped through the drill bit to help cool and lubricate the drill bit, provide bottom hole pressure, and carry cuttings to the surface. In drilling operations, the drill string may become stuck. A stuck drill string, often referred to as a "stuck pipe", occurs when the drill string cannot be moved up or down the wellbore without excessive force being applied.

Typically, mechanical and hydraulic tools or chemicals are utilized to free a stuck pipe in order to continue drilling operations. However, if these measures do not free the drill string, the operator may instruct the drill string to be cut. Subsequently, the freed part of the drill string may be pulled out-of-hole and a side-track may be drilled to continue the well. In most stuck pipe scenarios, especially mechanical stuck pipe scenarios, circulation is blocked within the drill string. This eliminates the capability of using hydraulic tools.

SUMMARY

A mechanical autonomous pipe cutting system for cutting a pipe in a wellbore includes a locking unit that prevents the system from moving within the pipe when engaged to an inner surface of the pipe, a punching unit that moves a plurality of punching elements radially relative to an axis of the system, and a cutting unit that is designed to sever the pipe. The locking unit, the punching unit, and the cutting unit are attached to a body of the mechanical autonomous pipe cutting system. The body includes a motor that rotates the cutting unit. The mechanical autonomous pipe cutting system further includes a sensor module that detects interactions between the pipe and walls of the wellbore and a control unit in electronic communication with the sensor module, the locking unit, and the punching unit. The control unit actuates the locking unit and operates the punching unit subsequent to identifying a location where interaction between the pipe and the walls of the wellbore limits a downhole movement of the pipe based on an output of the sensor module.

A method for cutting a pipe in a wellbore includes lowering a mechanical autonomous pipe cutting system downhole in the pipe to a location where interaction between the pipe and walls of the wellbore limits a downhole movement of the pipe, the location identified by a control unit of the system in electronic communication with a sensor module, a locking unit, and a punching unit based on output of the sensor module. The method further includes actuating the locking unit of the system to engage an inner surface of the pipe and to prevent the system from moving further downhole within the pipe. In addition, the method includes moving a plurality of punching elements of the punching unit radially relative to an axis of the system, rotating a cutting unit by a motor of a body of the system to sever the pipe, and retrieving the severed pipe to a surface location along with the system locked to the inner wall of the severed pipe.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

In one or more embodiments, this disclosure describes systems and methods of cutting a drill string stuck in a wellbore with a mechanical autonomous pipe cutting system. In one or more embodiments, the mechanical autonomous pipe cutting system includes a body, a locking unit, a sensor module, a punching unit, a cutting unit, and a control unit. The techniques discussed in this disclosure are beneficial in reducing the total time required to remove a stuck pipe from a wellbore, and thus, the associated costs. Further, the techniques discussed in this disclosure are beneficial as they may be performed even in the instance that circulation within the drill string is blocked.

Figure 1:
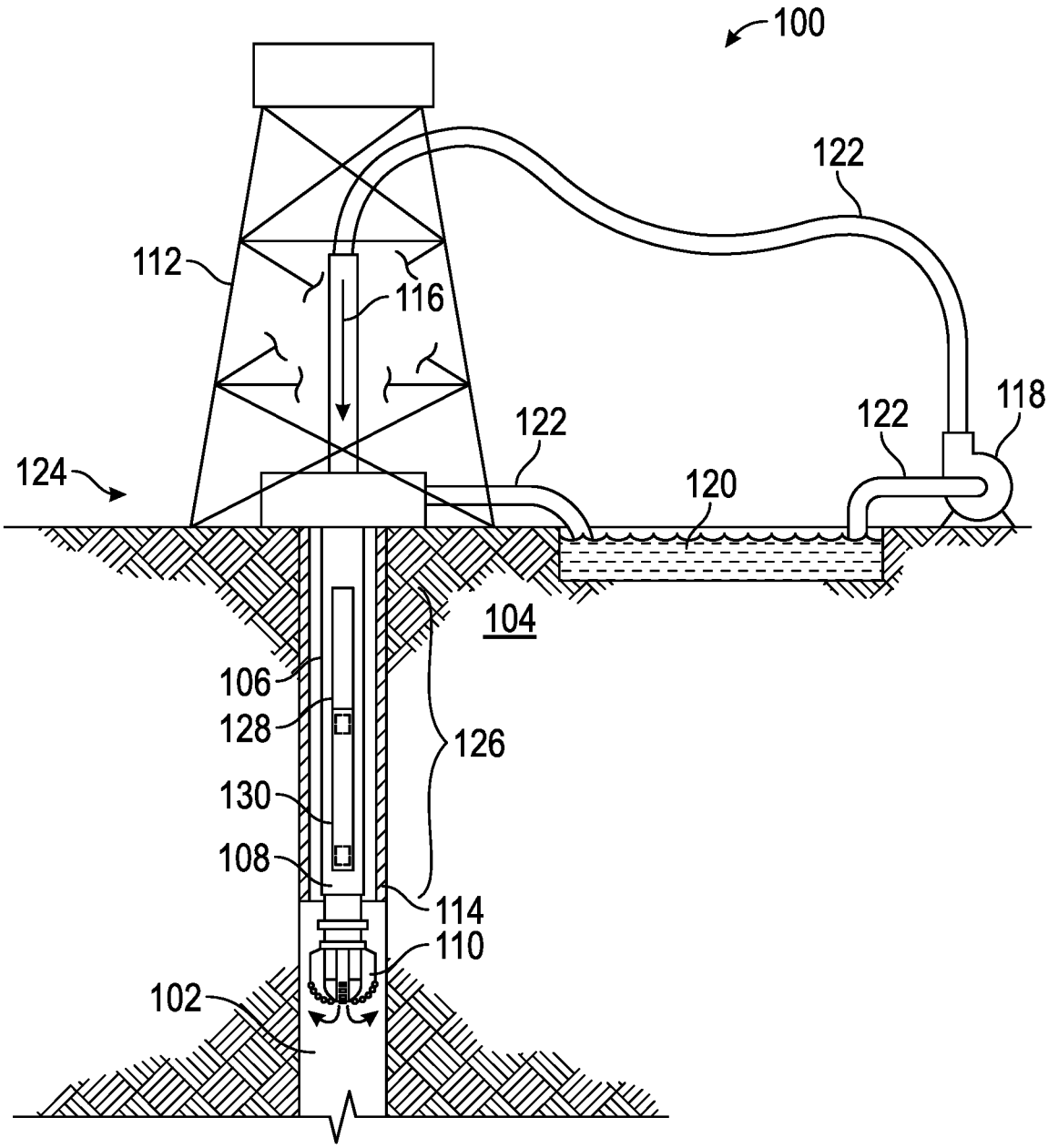
FIG. 1 shows an exemplary well site including a mechanical autonomous pipe cutting system in accordance with one or more embodiments.

FIG. 1 shows an exemplary well site (100) in accordance with one or more embodiments. The well site (100) is shown as being on land. In other examples, the well site (100) could be shown as being offshore with the drilling being carried out with or without use of a marine riser. A drilling operation at a well site (100) includes drilling a wellbore (102) into a subsurface of various formations (104). In order to drill a new section of wellbore (102), a drill string (106) is suspended within the wellbore (102). The drill string (106) includes one or more drill pipes (108) connected to form a conduit, and a Bottom Hole Assembly (BHA) is disposed at the distal end of the conduit. For cutting into the subsurface rock, a drill bit (110) is utilized as a part of the BHA. Further, the BHA may include measurement tools, such as a measurement-while-drilling (MWD) tool or a logging-while-drilling (LWD) tool, as well as other drilling tools that are not specifically shown but would be understood to a person skilled in the art.

A derrick structure (112) is used to suspend the drill string (106) in the wellbore (102). The wellbore (102) is illustrated as having a casing (114) but not all wellbores (102) are cased. During drilling operations, a casing (114) made up of one or more larger diameter tubulars that have a larger inner diameter than the drill string (106) but a smaller outer diameter than the wellbore (102) is lowered into the wellbore (102) on the drill string (106). The casing (114) is designed to isolate the internal diameter of the wellbore (102) from the adjacent formation (104). Once the casing (114) is positioned, it is set and cement is pumped down through the internal space of the casing (114), out of the bottom of a casing shoe, and into the annular space between the wellbore (102) and the outer diameter of the casing (114). This creates the desired isolation between the wellbore (102) and the formation (104) and secures the casing (114) in place. Afterwards, the drilling of the next section of the wellbore (102) begins.

During a drilling operation at the well site (100), in order to break rock, the drill string (106) is rotated relative to the wellbore (102) and weight is applied to the drill bit (110). In some cases, the drill bit (110) is rotated independently with a drilling motor. In other embodiments, the drill bit (110) is rotated using a combination of a drilling motor and a top drive to rotate the drill string (106). A drilling fluid (116) (sometimes referred to as drilling "mud") is pumped into the drill string (106) while the drill bit (110) cuts through the rock. A circulation pump (118) draws the mud from a mud pit (120) and pumps the mud into the drill string (106). Conduits (122) provide hydraulic connections between the circulation pump (118) and the drill string (106), between the wellbore (102) and the mud pit (120), and between the mud pit (120) and the circulation pump (118). The conduits (122) may include hoses, pipes, open channels, filters, or combinations of these components capable of handling the desired pressures and flowrates.

The mud flows down the drill string (106) and exits through a nozzle in the drill bit (110) into the bottom of the wellbore (102). Once in the wellbore (102), the mud flows back up to a surface location (124) in an annular space between the drill string (106) and the wellbore (102) carrying entrained cuttings to the surface location (124). The surface location (124) is any location outside of the well, such as the Earth's surface. The mud with the cuttings is returned to the mud pit (120) to be circulated back again into the drill string (106). Before pumping the mud again into the drill string (106), the cuttings are typically removed from the mud, and the mud is reconditioned as necessary.

Occasionally, the drill string (106) may get stuck within the wellbore (102) during drilling operations. The drill string (106) become stuck for a number of reasons. For example, the drill string (106) may become stuck within the wellbore (102) due to an accumulation of cuttings, differential pressure between the drill string (106) and the wellbore (102), or the geometry of the wellbore (102). When a drill string (106) becomes stuck, the drilling operation is halted as the drilling crew is unable to move the drill string (106) downhole to continue drilling. Further, when stuck, the drill string (106) is unable to be pulled out-of-hole.

Existing methods to sever the stuck drill string (106) familiar to one of ordinary skill in the art may include blind back off, wireline free point and back off, and hydraulic severing using pump down darts and dedicated subs. In the blind back off method, the drilling crew estimates where a portion of the drill string (106) is free from doing stretch tests. The drill string (106) is then put into neutral tension/compression at a point above the estimated position that the drill string (106) is stuck, or the "stuck location" of the drill string (106). Subsequently, negative torque is wound in. It is anticipated that the drill string (106) will part at a targeted connection of drill pipes (108). However, this method is not completely reliable as the drill string (106) may not part at the expected location.

In the wireline free point and back off method, a tool is run into the well on a wireline and tests are carried out to determine the stuck location of the drill string (106). An additional run is then required to transport the severing tool to the required location above the stuck location. However, this method presents associated dangers as the severing mechanism may employ explosives or chemicals that could potentially harm workers and the environment. In addition, in high angle wells, the wireline will need to be pumped or tractored into place. Optionally, the severing operation may be done with a mechanical cutting tool on a wireline powered from the surface location (124).

In the hydraulic severing method using pump down darts and dedicated subs, a sub or multiple dedicated dart receiver subs must always be run in the drill string (106) at predetermined depths. When a drill pipe (108) of the drill string (106) becomes stuck within the wellbore (102), a dart of a required outer diameter is dropped or pumped from the surface location (124) into the selected sub. Flow of a fluid (116) from the surface location (124) is then directed through the dart at a pin connection in the sub and, after some time, erosion of the metal in the pin weakens the pin, thereby eventually separating the connection. However, this method requires the location of the cut to be determined prior to the start of drilling. Further, the location of the subs is fixed once the subs enter the well. Consequently, the subs may be fixed in non-optimal positions.

However, when a drill string (106) becomes stuck within the wellbore (102), it is common for the drill string (106) to have an obstructed flow path, and therefore, circulation cannot be established within the drill string (106). As such, in the case of blocked circulation, hydraulically driven tools cannot be used in order to sever the drill string (106).

Accordingly, embodiments disclosed herein present systems and methods for cutting a stuck drill pipe (108) without the use of a wireline or coiled-tubing and without prior knowledge of the stuck location by employing a mechanical autonomous pipe cutting system (126). In addition, the mechanical autonomous pipe cutting system (126) may be employed to sever a stuck drill string (106) even when circulation is blocked within the drill string (106).

FIG. 1 further illustrates a mechanical autonomous pipe cutting system (126) dropped into the drill string (106) to cut the drill string (106) near the stuck location. The mechanical autonomous pipe cutting system (126) is an independent unit string tool that includes a body (128) and a sensor module (130). In the illustrated tool, the body (128) and the sensor module (130) are attached to each another with the sensor module (130) positioned at the downhole end of the body (128). In some tools, the sensor module (130) is incorporated inside the body (128) of the tool. As illustrated, the drilling fluid (116) being pumped down the drill string (106) may carry the mechanical autonomous pipe cutting system (126) down the drill string (106).

Figure 2:
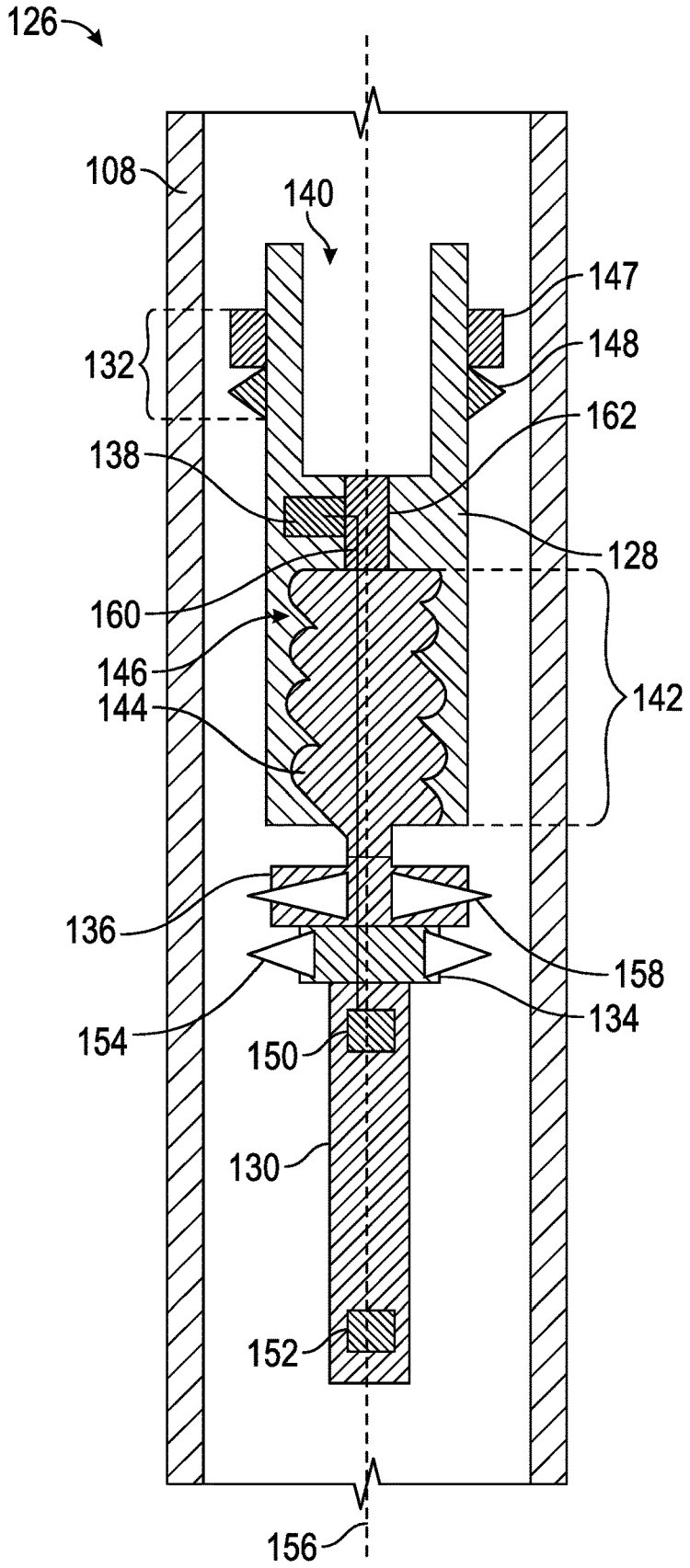
FIG. 2 shows a cross-sectional view of a mechanical autonomous pipe cutting system in accordance with one or more embodiments of the present disclosure.

FIG. 2 shows a cross-sectional view of a mechanical autonomous pipe cutting system (126) in accordance with one or more embodiments of the present disclosure. Here, the mechanical autonomous pipe cutting system (126) is disposed within a drill pipe (108) of a stuck drill string (106). The mechanical autonomous pipe cutting system (126) includes a body (128), a sensor module (130), a locking unit (132), a punching unit (134), a cutting unit (136), and a control unit (138). The body (128) of the system (126) may be tubular shaped and formed of a durable material such as steel. In addition, the body (128) includes an opening (140) at an upper end of the body (128). The opening (140) may receive a fluid (116) disposed within the drill string (106) and guide the fluid (116) towards a motor (142) of the body (128). In the embodiment depicted in FIG. 2, the motor (142) disposed within an interior of the body (128) is a hydraulic motor (142) and is formed of a rotor (144) and a stator (146). The rotor (144) is embedded inside of the stator (146) and may rotate as the fluid (116) passes through the hydraulic motor (142) of the body (128).

Disposed along an exterior of the body (128) is a locking unit (132). The locking unit (132) may include a packer (147) and/or slips (148). The packer (147) and/or slips (148) are employed to isolate and anchor the system, respectively, (126) in place within the drill string (106) prior to cutting the stuck drill pipe (108), thereby preventing axial and rotational motion of non-rotational components of the system (126). The packer (147) may be any packer known in the art such as a mechanical packer. Further, the packer (147) seals a space located between the system (126) and the drill string (106). In this way, fluid (116) is prevented from migrating pass the system (126) in the drill string (106) subsequent to the packer (147) being set. Additionally, the slips (148) may be a set of tapered elements that are forced outwardly from the body (128) against the drill string (106). The slips (148) may be forced against the drill string (106) by a battery powered mechanism or by a set of pre-pressurized pistons. The release of the pre-pressurized pistons may be electronically powered by a battery. As such, the when the slips (148) are pressed against the drill string (106), the tapered elements provide upward and downward forces upon the system (126), thereby fixing the position of the system (126) within the stuck drill pipe (108) of the drill string (106).

The mechanical autonomous pipe cutting system (126) further includes a sensor module (130). In FIG. 2, the sensor module (130) is situated at a downhole end of the system (126). However, in further embodiments, the sensor module (130) may be located within the body (128) of the system (126). The sensor module (130) may include sensors, instrumentation, and signal processing elements, such as circuits, transmitters (150), receivers (152), connecting probes, and data storing and processing devices. As such, the sensor module (130) may generate, for example, magnetic fields or acoustic waves that pass from the transmitter (150) to the receiver (152) in order to determine the stuck location of the drill string (106). Accordingly, the sensor module (130) is utilized to sense properties of the drill pipes (108) as the system (126) is lowered downhole within the drill string (106). Specifically, the sensor module (130) or the control unit (138) identifies the stuck location by sensing a transition between a portion of the drill pipe (108) in tension and a portion of the drill pipe (108) in a relaxed state.

The punching unit (134) of the system (126) may be attached to the body (128) of the system (126) directly uphole from the sensor module (130) as shown in FIG. 2. The punching unit (134) includes a plurality of punching elements (154) that are formed of a durable material such as steel, tempered steel, or tungsten carbide. The punching elements (154) may be shaped as a cone, pyramid, blade, or another shape capable of puncturing a hole or slit through the drill pipe (108). As such, the punching elements (154) are utilized to punch one or more holes in the stuck drill pipe (108) subsequent to reaching the stuck location in order to create a path for the fluid (116) to flow. In this way, circulation is established or re-established within the drill string (106) and hydraulically powered downhole mechanisms are capable of functioning.

In order to punch through the drill pipe (108), the punching elements (154) move radially relative to an axis (156) of the system (126). The punching elements (154) may be pressed through the drill pipe (108) by a battery powered mechanism or by another means, such as pre-pressurized pistons. This piston can be released through a low-power control system powered by a battery. Furthermore, the punching unit (134) may include a punching unit casing to house the components employed to move the punching elements (154) and the punching elements (154) prior to the punching elements (154) being transported towards the stuck drill pipe (108).

Situated uphole from the punching unit (134) is the cutting unit (136) of the system (126). The cutting unit (136) serves to sever the stuck drill pipe (108) subsequent to locking unit (132) of the system (126) anchoring the system (126) to the drill string (106). The cutting unit (136) may include a plurality of cutting elements (158). Similar to the punching elements (154) of the punching unit (134), the cutting elements (158) are formed of a durable material such as steel, tempered steel, or tungsten carbide. Each of the cutting elements (158) may include a milling knife, a blade, or another structure capable of severing a drill pipe (108).

The cutting unit (136) may further include a cutting unit casing that houses the cutting elements (158) when the cutting elements (158) are in a running position. The running position is defined as the position of the cutting elements (158) as the system (126) is lowered within the wellbore (102). In the running position, the cutting elements (158) may be fully or partially encased within the cutting unit casing. Further, the cutting unit casing may also enclose a plurality of linear actuators attached to the cutting elements (158). Each linear actuator moves an associated cutting element radially relative to the axis (156) of the system (126). In this way, the linear actuators enable the cutting elements (158) to move between the running position and a cutting position. The cutting position is defined as the position of the cutting elements (158) when the cutting elements (158) are pressed against the stuck drill pipe (108). In addition, the linear actuators may be battery powered or hydraulically actuated.

The cutting unit (136) is attached to the body (128) of the system (126). Specifically, the cutting unit (136) is connected and rotationally fixed to the rotor (144) of the motor (142) of the body (128) such that rotation of the rotor (144) rotates the cutting unit (136). Accordingly, when the cutting elements (158) are in the cutting position, the rotation of the rotor (144) causes the cutting elements (158) to rotate and sever the stuck drill pipe (108).

The sensor module (130), locking unit (132), punching unit (134), and cutting unit (136) are each in electronic communication with the control unit (138) of the system (126) through a communication channel (160). The control unit (138) receives an output from the sensor module (130). The output from the sensor module (130) may specify the location where the drill string (106) is stuck within the wellbore (102), or the control unit (138) may interpret data received from the sensor module (130) to identify the location where the drill string (106) is stuck. As mentioned previously, the stuck location of the drill string (106) points out a location where the interaction between a drill pipe (108) of the drill string (106) and walls of the wellbore (102) limits a movement of the drill string (106). A number of different events may enforce limitations among the downhole movement of the drill string (106) at the interface between the drill string (106) and the wellbore (102).

In addition, subsequent to identifying the stuck location of the drill string (106), the control unit (138) actuates the locking unit (132) and operates the punching unit (134) and the cutting unit (136), thereby moving the punching elements (154) and the cutting elements (158) radially towards the drill pipe (108). Furthermore, the control unit (138) may regulate a flow of the fluid (116) through the motor (142) of the system (126) by controlling a main valve (162). The main valve (162) may be any valve known in the art such as a gate valve. In FIG. 2, the main valve (162) is depicted as connecting the opening (140) of the body (128) and the motor (142). In this way, when the main valve (162) is closed, fluid (116) is prevented from entering the motor (142) and the rotor (144) does not rotate. However, when the main valve (162) is open, fluid (116) may pass from the opening (140) of the body (128) into the motor (142) of the body (128), thereby hydraulically actuating the motor (142) and rotating the cutting unit (136).

Figure 3A:
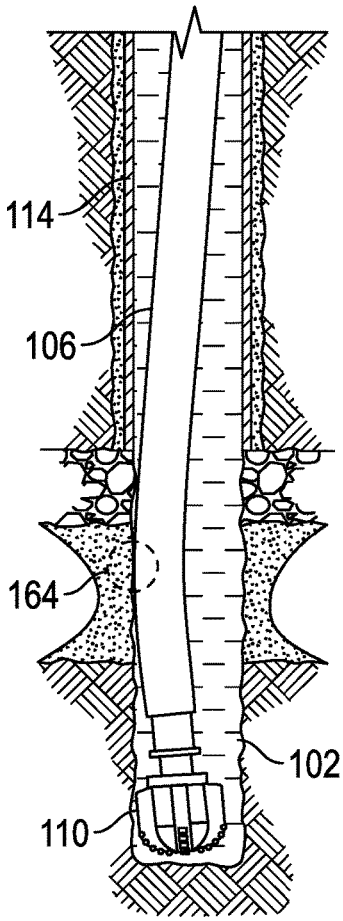
FIGS. 3A-3C depict an operational sequence of the system in accordance with one or more embodiments.
Figure 3B:
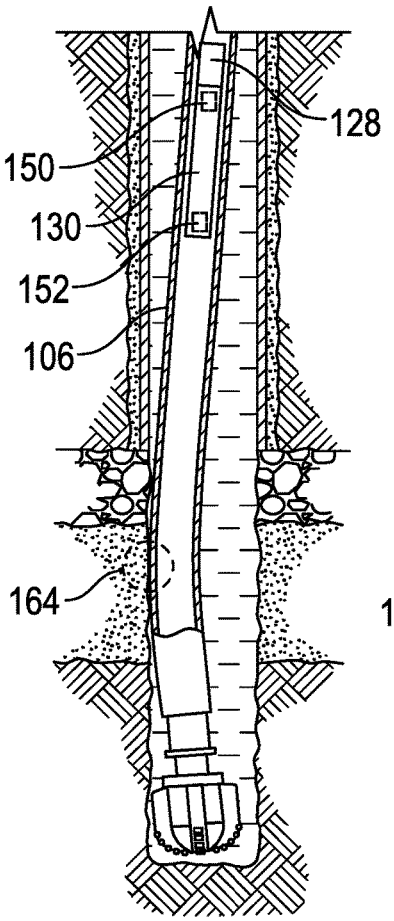
Figure 3C:
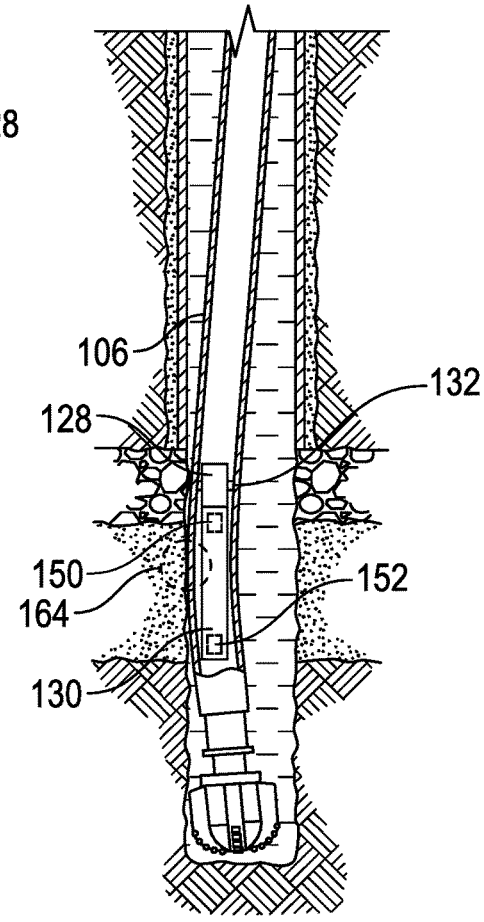

FIGS. 3A-3C illustrate an operational sequence of the system (126) in accordance with one or more embodiments. Specifically, in FIG. 3A, the drill string (106) is depicted as being stuck against a wall of the wellbore (102) due to differential pressure. The point of contact between the wall of the wellbore (102) and the drill string (106) is the stuck location (164). Generally, when a drill string (106) is determined to be stuck by a drilling crew, operators of the drilling crew attempt to free the drill string (106) by various methods. These methods, as known in the art, may include applying cycles of high-force pick-ups and slack-offs, spotting acids, or using jars.

If the drilling crew cannot free the stuck drill pipe (108) of the drill string (106), the operators may elect to drop the mechanical autonomous pipe cutting system (126) into the drill string (106), as shown in FIG. 3B. The system (126) may travel downhole within the drill string (106) with a fluid (116) at a controlled speed. Here, a flow rate of the fluid (116) controls a velocity of the system (126) while travelling downhole.

In the case of blocked circulation, the system (126) cannot utilize any hydraulically driven delivery methods. In the case of low inclination sections, the system (126) may rely on gravity to reach the stuck location (164) downhole. The system (126) may also be delivered using motorized turbines. These delivery systems may be battery powered and controlled by the control unit (138). To better control the rate of descent in the wellbore (102), and to also ensure reaching the target location without overshooting the target, the velocity of the system (126) may be controlled. In order to control the velocity of the system (126), the outer diameter of the system (126) may be modified with respect to an inner diameter of the drill string (106). Alternatively, tractors which operate in both directions (uphole and downhole) and include wheels may be utilized. This feature is beneficial in accurately positioning the system (126) with the stuck location (164). In the case of high inclination angles or horizontal sections, to ensure proper delivery of the system (126) to the location of the stuck drill pipe (108), the system (126) may employ motorized methods, such as tractors with wheels. In the case a motorized method is not an option, the system (126) may be set in place at the furthest point downhole the system (126) is capable of reaching uphole from the stuck location (164) before severing the pipe.

In the event the system (126) is able to travel all the way downhole in the drill string (106) to the BHA, the system (126) is fixed within the stuck drill pipe (108) by the locking unit (132) when the sensor module (130) of the system (126) identifies the stuck location (164), as seen in FIG. 3C. The sensor module (130) senses properties of the drill pipes (108) of the drill string (106) and the sensor module (130) or the control unit (138) identifies the stuck location (164) by recognizing a transition between a portion of the drill string (106) in tension and a portion of the drill string (106) in a relaxed state. Further, in the case where motorized delivery mechanisms are utilized, the system (126) may travel uphole or downhole within the stuck drill pipe (108) to position the cutting unit (136) at an optimum cutting location based on the readings from the sensor module (130).

Figure 4C:
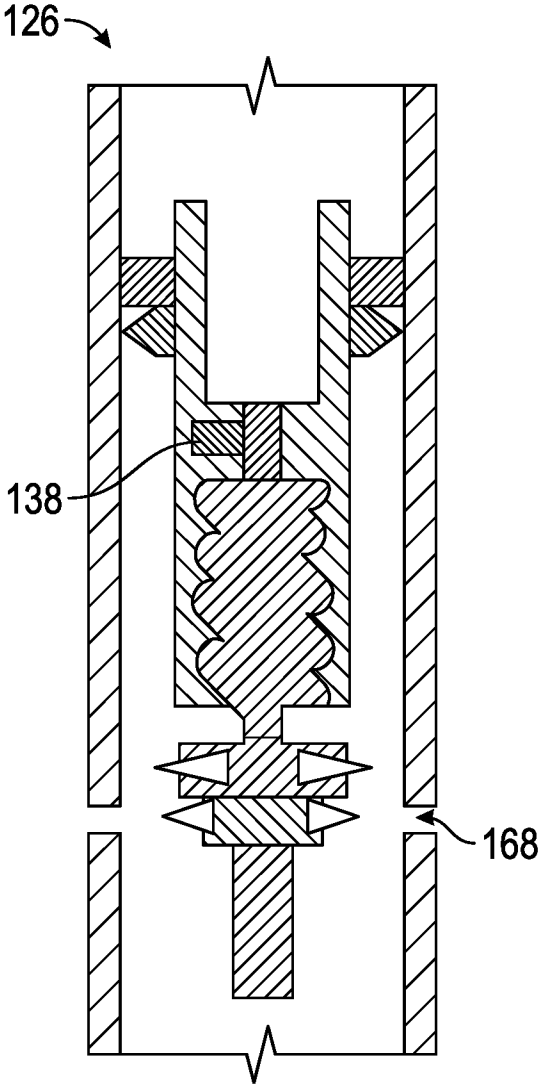
FIGS. 4A-4C depict an operational sequence of the system in accordance with one or more embodiments.
Figure 4B:
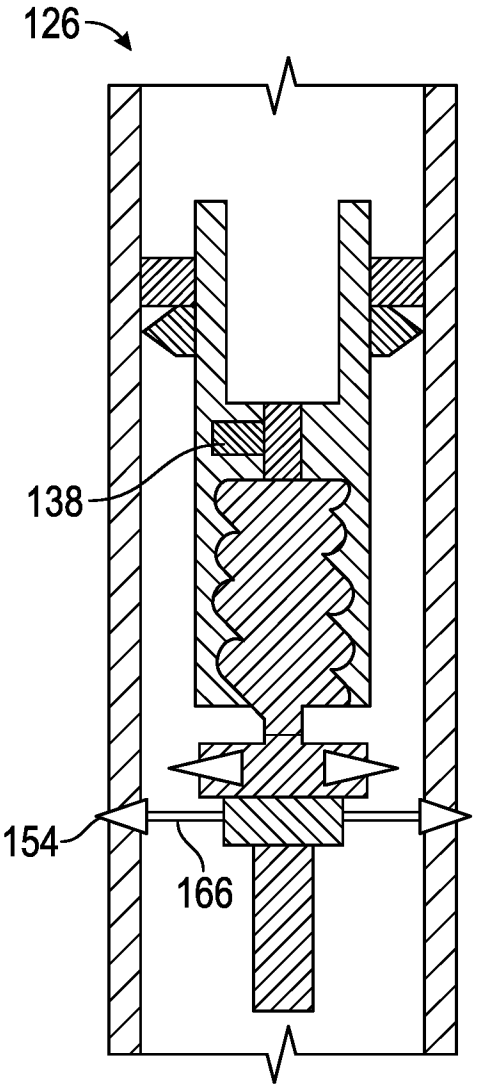
Figure 4A:
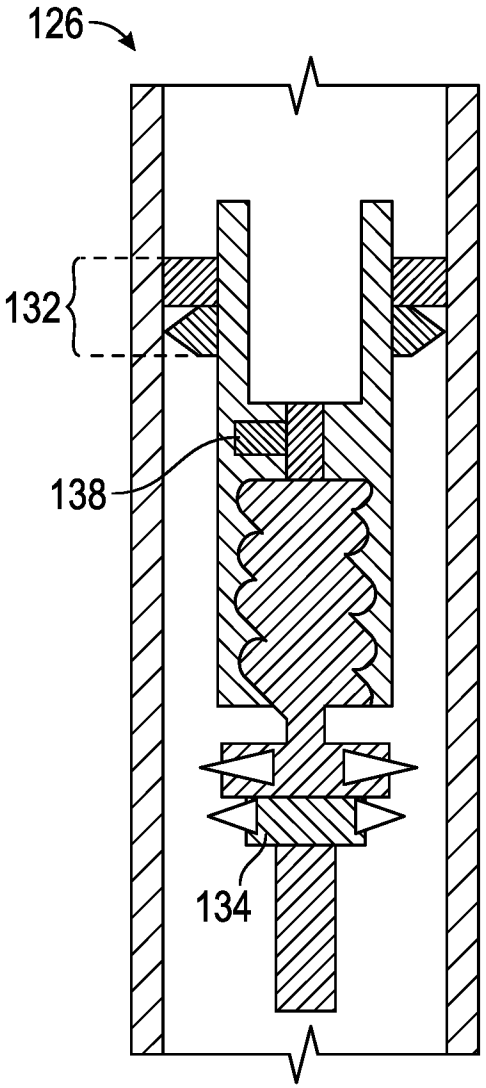

FIGS. 4A-4C depict an operational sequence of the system (126) subsequent to locating a stuck location (164) of a drill pipe (108) in accordance with one or more embodiments. Once the stuck location (164) is located by the sensor module (130), the control unit (138) receives an output from the sensor module (130) and sends a signal to the locking unit (132). In turn, the packer (147) and/or slips (148) of the locking unit (132) are actuated to anchor the system (126) against the drill string (106) as depicted in FIG. 4A.

If it is determined by the drilling crew that circulation through the stuck drill string (106) is blocked, subsequent to the system (126) being secured to the drill string (106), the control unit (138) may send a signal to the punching unit (134). Upon receiving a signal from the control unit (138) via the communication channel (160), the punching elements (154) of the punching unit (134) are forced outwardly from the punching unit casing towards the drill pipe (108). As seen in FIG. 4B, pre-pressurized pistons (166) force the punching elements (154) through the drill pipe (108) above the stuck location (164). Consequently, one or more holes (168) along the stuck drill pipe (108) are created, as seen in FIG. 4C. Further, circulation is restored within the drill string (106) subsequent to the punching unit (134) piercing holes (168) through the stuck drill pipe (108). In addition, the punching elements (154) may be retracted back towards the punching unit casing subsequent to piercing holes (168) through the stuck drill pipe (108). This may be facilitated by springs, retrieving coils, or actuators.

Figure 5A:
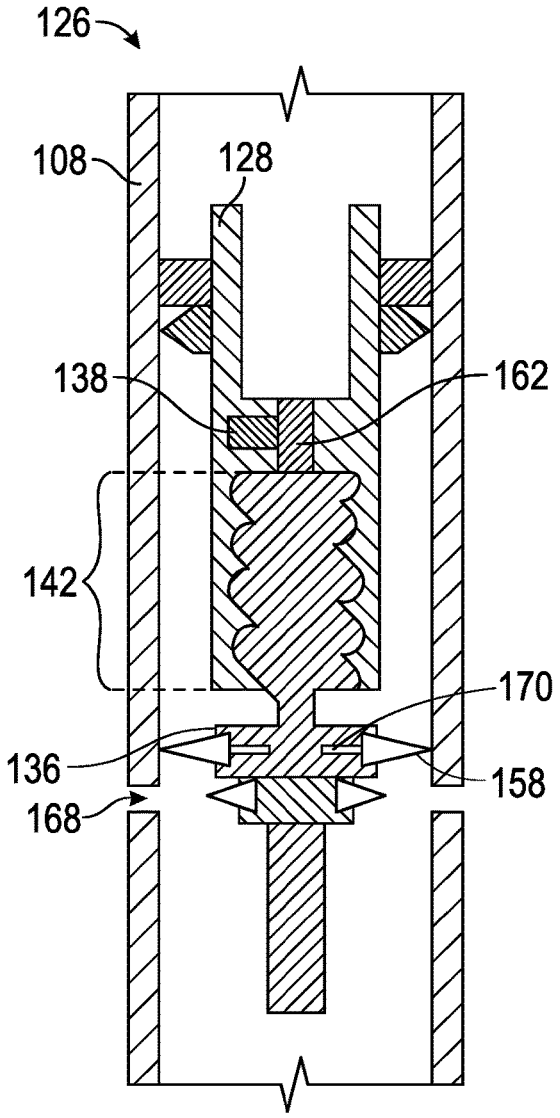
FIGS. 5A and 5B depict an operational sequence of the system in accordance with one or more embodiments.
Figure 5B:
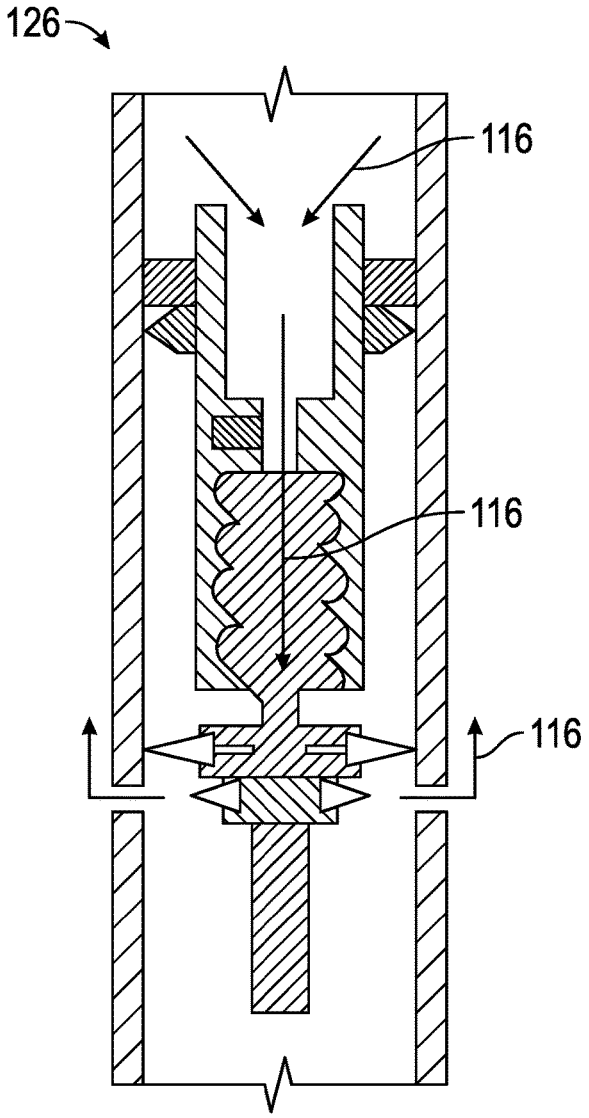

FIGS. 5A and 5B depict an operational sequence of the system (126) when circulation is available throughout the drill string (106) in accordance with one or more embodiments. Specifically, in FIG. 5A, the control unit (138) sends a signal to the cutting unit (136) to move the cutting elements (158) from the running position to the cutting position subsequent to the punching unit (134) creating holes (168) within the stuck drill pipe (108). The cutting elements (158) are moved from the running position to the cutting position by linear actuators (170) of the cutting unit (136). Once the cutting elements (158) are engaged with the drill pipe (108), the control unit (138) opens the main valve (162) of the body (128). In this way, fluid (116) is now permitted to flow through the system (126).

In FIG. 5B, fluid (116) enters the system (126) through the opening (140) of the body (128). Fluid (116) flowing downhole within the drill string (106) is forced to pass through the system (126) due to the seal created by the locking unit (132) between the drill string (106) and the exterior of the body (128) of the system (126). From the opening (140), the fluid (116) travels downhole through the main valve (162) into the motor (142) of the body (128). Accordingly, the flow of the fluid (116) hydraulically actuates the motor (142). As the rotor (144) of the motor (142) is rotated by the fluid (116) flowing through the motor (142), the connected cutting unit (136) also rotates. Consequently, the cutting elements (158) of the cutting unit (136) cut the stuck drill pipe (108) while fluid (116) passes through the motor (142).

Subsequent to exiting the motor (142), the fluid (116) exits the system (126) and enters the drill string (106) below the locking unit (132). The fluid (116) may exit the system (126) through apertures along the cutting unit (136) or through apertures along the punching unit (134). Further, fluid (116) may exit the system (126) below the punching unit (134) through apertures disposed along the sensor module (130). In addition, connection devices utilized to connect the rotor (144) to the cutting unit (136), the cutting unit (136) to the punching unit (134), and the punching unit (134) to the sensor module (130) may include apertures that permit fluid (116) to exit the system (126).

Upon exiting the system (126), fluid (116) may flow downhole of the system (126) within the drill string (106). In addition, fluid (116) may exit the drill string (106) through the holes (168) created in the drill pipe (108) by the punching unit (134). Upon exiting the drill string (106), the fluid (116) may be transported back towards the surface location (124) through the annulus between the drill string (106) and the wellbore (102) by the circulation pump 118.

Once the cutting unit (136) fully severs the stuck drill pipe (108), the flow of the fluid (116) may be halted by the drilling crew at the surface location (124). In addition, the portion of the drill string (106) above the stuck drill pipe (108) may be returned to the surface location (124) by a fishing operation. Accordingly, the system (126) is returned to the surface location (124) with the portion of the drill string (106) above the stuck drill pipe (108) as the system (126) remains anchored to the drill string (106) until the locking unit (132) of the system (126) is disengaged. The system (126) may be disengaged by the control unit (138) at the surface location (124).

Figure 6:
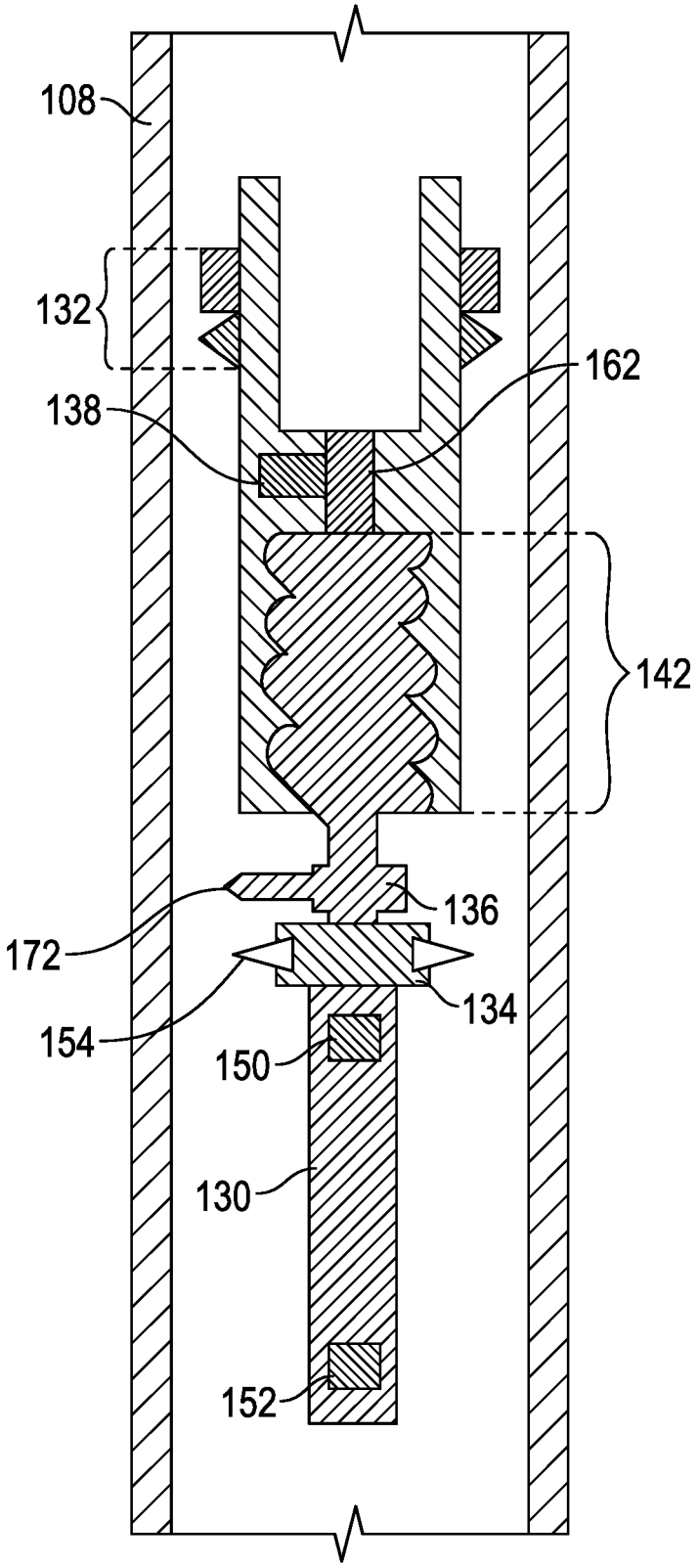
FIG. 6 shows a cross-sectional view of a mechanical autonomous pipe cutting system in accordance with one or more embodiments of the present disclosure.

FIG. 6 shows another embodiment of a mechanical autonomous pipe cutting system (126) in accordance with one or more embodiments of the present disclosure. Components shown in FIG. 6 that have been described in FIGS. 2-5 have not been redescribed for purposes of readability and have the same description and purpose as outlined above. However, in this embodiment, the cutting unit (136) includes a jet cutter (172). The jet cutter (172) channels fluid (116) flowing from the motor (142) into the cutting unit (136) from axial to radial flow at a high velocity to erode and sever the stuck drill pipe (108) uphole from the stuck location (164). The jet cutter (172) includes a nozzle that protrudes radially relative to the axis (156) of the system (126) and focuses the flow of the fluid (116) towards the drill pipe (108). Due to the high velocity flow of the fluid (116), the nozzle and internal components of the jet cutter (172) are made of erosion resistant metals or ceramics. In addition, because the cutting unit (136) is rotationally fixed to rotor (144) of the motor (142), the jet cutter (172) rotates with the rotor (144) permitting the jet cutter (172) to fully sever the drill pipe (108).

Here, the cutting unit (136) is not in direct communication with the control unit (138). However, the cutting unit (136) is regulated by the main valve (162). When the main valve (162) is closed, the fluid (116) is prevented from entering the motor (142) of the body (128) and thus the cutting unit (136). When the main valve (162) is opened by the control unit (138), fluid (116) is permitted to pass through the motor (142), thereby rotating the cutting unit (136). Further, when the main valve (162) is open, fluid (116) is ejected from the system (126) through the jet cutter (172) of the cutting unit (136).

Figure 7:
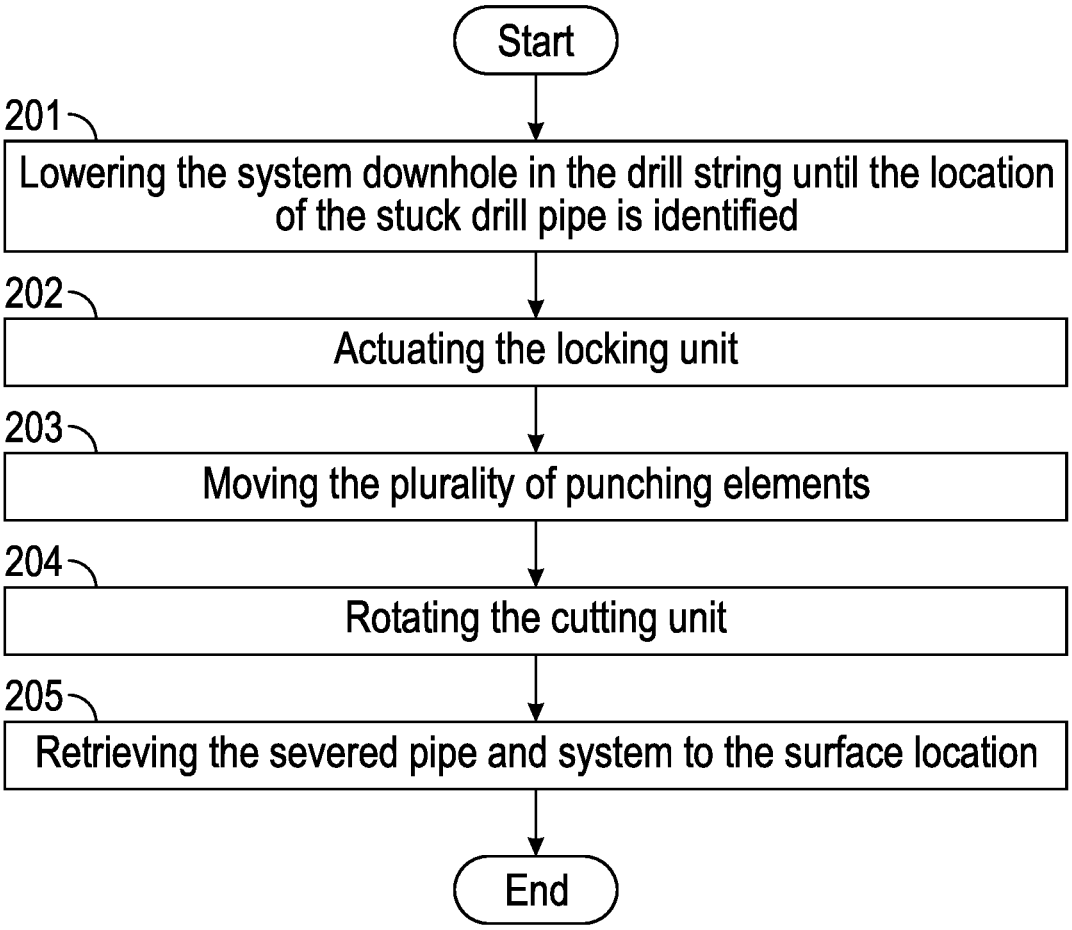
FIG. 7 shows a flowchart of a method in accordance with one or more embodiments of the present disclosure.

FIG. 7 depicts a flowchart showing a method for cutting a stuck pipe in a wellbore (102) with the use of a mechanical autonomous pipe cutting system (126). While the various flowchart blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 201, the mechanical autonomous pipe cutting system (126) is lowered downhole within the drill string (106) until the stuck location (164) is identified or reached. The system (126) may be lowered by a fluid (116) flowing through the drill string (106) if circulation within the drill string (106) is maintained. If the circulation is blocked within the drill string (106), the system (126) may be lowered by gravity or by battery powered delivery systems, such as motorized turbines or tractors.

While travelling downhole within the drill string (106), the sensor module (130) of the system (126) senses properties of the drill pipes (108) of the drill string (106). The stuck location (164) of the drill string (106) is identified by the sensor module (130) or the control unit (138) by recognizing a transition between a portion of the drill string (106) in tension and a portion of the drill string (106) in a relaxed state.

In block 202, at the stuck location (164), the control unit (138) sends a signal to the locking unit (132) via the communication channel (160) in order to actuate the locking unit (132). As such, the packer (147) and/or slips (148) of the locking unit (132) extend radially from the locking unit (132) to the drill pipe (108). Accordingly, the packer (147) and/or slips (148) engage the drill string (106), thereby anchoring the system (126) within the drill string (106) and sealing the space between the system (126) and the drill string (106). Further, the locking unit (132) prevents rotation of non-rotating components of the system (126) within the wellbore (102) while the system (126) is anchored to the drill string (106).

In block 203, subsequent to the locking unit (132) anchoring the system (126) to the drill string (106) at the stuck location (164), the control unit (138) sends a signal to the punching unit (134) via the communication channel (160). Upon receiving a signal from the control unit (138), the punching elements (154) of the punching unit (134) are extended radially by battery powered mechanisms or pre-pressurized pistons (166) until the punching elements (154) puncture one or more holes (168) through the stuck drill pipe (108). After creating holes (168) in the stuck drill pipe (108), the punching elements (154) are returned to the punching unit casing by the battery powered mechanisms or pre-pressurized pistons (166).

In block 204, when circulation within the drill string (106) is restored as a result of holes (168) being punched through the stuck drill pipe (108), the control unit (138) sends a signal to the cutting unit (136) via the communication channel (160). Subsequently, the cutting elements (158) of the cutting unit (136) are moved from the running position to the cutting position by linear actuators (170) of the cutting unit (136). Once the cutting elements (158) of the cutting unit (136) are engaged with the stuck drill pipe (108), the control unit (138) opens the main valve (162) of the body (128) of the system (126). As a result, fluid (116) disposed uphole of the system (126) is forced to pass through the system (126) due to the seal created by the locking unit (132). Accordingly, fluid (116) enters the system (126) through the opening (140) of the body (128), passes through the main valve (162), and enters the motor (142) of the body (128).

As the fluid (116) flows through the motor (142) of the body (128), the fluid (116) causes the rotor (144) of the motor (142) to rotate. In turn, the cutting unit (136), rotationally fixed to the rotor (144), rotates with the rotor (144). Therefore, as fluid (116) passes through the motor (142), the cutting unit (136) rotates and cuts into and through the stuck drill pipe (108) at the stuck location (164).

In additional embodiments, a jet cutter (172) of the cutting unit (136) is utilized to sever the stuck drill pipe (108). As such, upon circulation being restored within the drill string (106), the control unit (138) opens the main valve (162). In this way, fluid (116) passing through the motor (142) of the system (126) is utilized to rotate the motor (142) and erode the stuck drill pipe (108) upon exiting the cutting unit (136) at a high velocity in a direction towards the stuck drill pipe (108).

In block 205, subsequent to the cutting unit (136) severing the stuck drill pipe (108), the portion of the drill string (106) disposed uphole of the stuck location (164) may be retrieved to the surface location (124) by a fishing operation. In doing so, the system (126) is also returned to the surface location (124) as the locking unit (132) of the system (126) is anchored within this portion of the drill string (106). At the surface location (124), the locking unit (132) may disengage from the drill string (106). In addition, drilling operations may continue subsequent to this portion of the drill string (106) being removed from the well by side-tracking a new wellbore (102).

Accordingly, the aforementioned embodiments as disclosed relate to systems (126) and methods useful for cutting a stuck pipe within a wellbore (102) autonomously. The aforementioned embodiments may be employed to sever a stuck drill string (106) even when circulation is blocked within the drill string (106). Advantageously, the disclosed systems (126) and methods of cutting a stuck drill pipe (108) may be utilized without being supported from the surface location (124) by a wireline or coiled-tubing. Further, the disclosed systems (126) and methods advantageously sever a stuck drill pipe (108) at the stuck location (164) without having prior knowledge of the stuck location (164). Accordingly, the disclosed systems (126) and methods reduce the total time required to remove a stuck drill string (106) from a wellbore (102), and thus, the associated costs.

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A mechanical autonomous pipe cutting system configured to cut a pipe in a wellbore, the mechanical autonomous pipe cutting system comprising:

a body comprising a motor;

a locking unit attached to the body, the locking unit configured to prevent the system from moving within the pipe when engaged to an inner surface of the pipe;

a sensor module configured to detect interactions between the pipe and walls of the wellbore;

a punching unit attached to the body, the punching unit configured to move a plurality of punching elements radially relative to an axis of the system;

a cutting unit attached to the body and rotatable by the motor, the cutting unit configured to sever the pipe; and a control unit in electronic communication with the sensor module, the locking unit, and the punching unit, the control unit being configured to actuate the locking unit and operate the punching unit subsequent to identifying a location where interaction between the pipe and the walls of the wellbore limits a downhole movement of the pipe based on an output of the sensor module, wherein the system is configured to be independently dropped or pumped downhole through the pipe, and wherein the system is not supported by a wireline or coil-tubing from a surface of the wellbore.

2. The mechanical autonomous pipe cutting system according to claim 1, wherein the cutting unit is disposed uphole from the punching unit.

3. The mechanical autonomous pipe cutting system according to claim 1, wherein the sensor module is disposed downhole from the body.

4. The mechanical autonomous pipe cutting system according to claim 1, wherein the locking unit comprises a packer.

5. The mechanical autonomous pipe cutting system according to claim 1, wherein the locking unit comprises slips.

6. The mechanical autonomous pipe cutting system according to claim 1, wherein the cutting unit comprises a jet cutter.

7. The mechanical autonomous pipe cutting system according to claim 1, wherein the cutting unit comprises:

a plurality of cutting elements; and a plurality of linear actuators attached to the plurality of cutting elements, each linear actuator configured to move an associated cutting element radially relative to the axis of the system.

8. The mechanical autonomous pipe cutting system according to claim 1, wherein the punching elements of the punching unit are powered by a piston to punch a plurality of holes through the pipe.

9. The mechanical autonomous pipe cutting system according to claim 1, wherein the body further comprises a main valve controlled by the control unit, the main valve configured to regulate a flow of a fluid through the system.

10. The mechanical autonomous pipe cutting system according to claim 1, wherein the sensor module comprises an acoustic transmitter oriented to send an acoustic signal radially relative to the axis of the system.

11. The mechanical autonomous pipe cutting system according to claim 1, wherein the motor is a hydraulic motor.

12. The mechanical autonomous pipe cutting system according to claim 11, wherein the hydraulic motor comprises a rotor embedded inside a stator and the cutting unit is rotationally fixed to the rotor.

13. A method for cutting a pipe in a wellbore comprising:

independently lowering, without being supported by a wireline or coil-tubing from a surface of the wellbore, a mechanical autonomous pipe cutting system downhole in the pipe to a location where interaction between the pipe and walls of the wellbore limits a downhole movement of the pipe, the location identified by a control unit of the system in electronic communication with a sensor module, a locking unit, and a punching unit based on output of the sensor module;

actuating the locking unit of the system to engage an inner surface of the pipe and to prevent the system from moving further downhole within the pipe;

moving a plurality of punching elements of the punching unit radially relative to an axis of the system;

rotating a cutting unit by a motor of a body of the system to sever the pipe; and retrieving the severed pipe to a surface location along with the system locked to the inner wall of the severed pipe.

14. The method according to claim 13, further comprising punching holes through the pipe with the punching elements.

15. The method according to claim 13, further comprising moving a plurality of cutting elements of the cutting unit radially relative to the axis of the system by a plurality of linear actuators.

16. The method according to claim 13, wherein actuating the locking unit of the system comprises sealing a space between the system and the inner wall of the pipe.

17. The method according to claim 13, further comprising opening a main valve of the body by the control unit to permit a fluid to flow downhole through the system.

18. The method according to claim 17, wherein opening a main valve of the body by the control unit comprises hydraulically actuating the motor of the body.

19. The method according to claim 13, wherein lowering the system downhole in the pipe comprises utilizing battery powered delivery systems to lower the system.

20. The method according to claim 19, wherein lowering the system downhole in the pipe comprises regulating a velocity of the system.

* * * * *